US012247569B2

(12) United States Patent
Fleischmann

(10) Patent No.: US 12,247,569 B2
(45) Date of Patent: Mar. 11, 2025

(54) PUMP WITH COMBINED ELECTRICAL CONTACT

(71) Applicant: Modine Manufacturing Company, Racine, WI (US)

(72) Inventor: Zachary Fleischmann, Waterford, WI (US)

(73) Assignee: Modine Manufacturing Company, Racine, WI (US)

( * ) Notice: Subject to any disclaimer, the term of this patent is extended or adjusted under 35 U.S.C. 154(b) by 199 days.

(21) Appl. No.: 18/126,103

(22) Filed: Mar. 24, 2023

(65) Prior Publication Data

US 2023/0304500 A1 Sep. 28, 2023

Related U.S. Application Data

(60) Provisional application No. 63/323,900, filed on Mar. 25, 2022.

(51) Int. Cl.

| | |
|---|---|
| ***F04B 49/06*** | (2006.01) |
| ***F04D 13/06*** | (2006.01) |
| ***F04D 15/00*** | (2006.01) |

(52) U.S. Cl.

CPC ..... *F04D 15/0077* (2013.01); *F04D 13/0693* (2013.01); *F04D 15/0094* (2013.01)

(58) Field of Classification Search

CPC ..... F04D 15/00; F04D 13/0693; F04D 27/00; F04D 25/0693; F04B 40/00; F04B 40/06; F04B 40/065; F04B 51/00

See application file for complete search history.

(56) References Cited

U.S. PATENT DOCUMENTS

| | | | |
|---|---|---|---|
| 4,661,914 | A | 4/1987 | Mulokey et al. |
| 5,947,189 | A | 9/1999 | Takeuchi et al. |

(Continued)

FOREIGN PATENT DOCUMENTS

| | | | |
|---|---|---|---|
| CN | 208502991 | U | 2/2019 |
| EP | 3239520 | A1 | 11/2017 |
| EP | 3626973 | A1 | 3/2020 |

OTHER PUBLICATIONS

Didier, P. et al. Converged Plantwide Ethernet (CPwE) Design and Implementation Guide. Sep. 9, 2011. Accessed online at https://literature.rockwellautomation.com/idc/groups/literature/documents/td/enet-td001_-en-p.pdf (564 pages).

(Continued)

*Primary Examiner* — Thomas Fink

(74) *Attorney, Agent, or Firm* — Michael Best & Friedrich LLP

(57) ABSTRACT

A vehicle system including a pump having a motor and a pullout configuration with an electrical contact. The electrical contact receives and transmits signals related to an operation of the pump and an address selection. The pump also includes a motor controller. The vehicle system also includes a system controller bus communicatively connected to the pinout configuration and a system controller communicatively connected to the pump via the system controller bus. The system controller determines that the electrical contact is energized, determines that a resistor is electrically connected to the electrical contact after determining that the electrical contact is energized, determines a resistance value of the resistor after determining that the resistor is electrically connected to the electrical contact, identifies the pump based on the resistance value, and transmits a control signal to the motor controller to control the operation of the pump.

20 Claims, 4 Drawing Sheets

(56) References Cited

U.S. PATENT DOCUMENTS

| | | | | |
|---|---|---|---|---|
| 6,239,991 | B1 | 5/2001 | Ajro et al. | |
| 6,647,302 | B2 | 11/2003 | Pouchak | |
| 7,219,255 | B2 | 5/2007 | Khalil et al. | |
| 7,444,207 | B2 | 10/2008 | Nickerson et al. | |
| 9,567,893 | B2 | 2/2017 | Kis et al. | |
| 10,040,440 | B2 | 8/2018 | Iwagami et al. | |
| 10,316,730 | B2 | 6/2019 | Kis et al. | |
| 2005/0026507 | A1 | 2/2005 | Pedrini et al. | |
| 2011/0220042 | A1 | 9/2011 | Suzuki | |
| 2012/0205171 | A1 | 8/2012 | Takishita et al. | |
| 2015/0176469 | A1 | 6/2015 | Kis et al. | |
| 2017/0063281 | A1 | 3/2017 | Zhang et al. | |
| 2020/0223546 | A1 | 7/2020 | Yu | |
| 2020/0232453 | A1 | 7/2020 | Hattori et al. | |
| 2020/0240115 | A1* | 7/2020 | Kondo | F16K 31/06 |
| 2021/0173717 | A1 | 6/2021 | Schmitz et al. | |
| 2021/0396235 | A1* | 12/2021 | Eser | F04D 15/0227 |
| 2023/0229132 | A1* | 7/2023 | Heinrich | G05B 19/045 700/282 |

OTHER PUBLICATIONS

U.S. Dept. of Energy. "Improved Controls for Fusion RF Systems". Nov. 8, 2011, accessed online at https://www.osti.gov/servlets/purl/1028794 (35 pages).

Mendonca, T.J.F. Electronics Based VPGM Controller Board. Diss. Universidade do Porto (Portugal), 2018, (165 pages).

International Search Report and Written Opinion for Application No. PCT/US2023/016259 dated May 31, 2023 (17 pages).

* cited by examiner

300

| | "XX" CAN BE ANY 2 CHARACTERS | FAILSAFE ACTIVE? | PUMP SOURCE ADDRESS | PUMP RECEIVE MESSAGE | PUMP TRANSMIT MESSAGE |
|---|---|---|---|---|---|
| 305 | PUMP — PIN A (OPEN) | NO | 0x96 | 0xXX7B96XX OR 0xXX7BFFXX | 0x18FBFF96 |
| 310 | PUMP — PIN A (SHORT) — 24V | YES | 0x96 | 0xXX7B96XX OR 0xXX7BFFXX | 0x18FBFF96 |
| 315 | PUMP — PIN A — [resistor] — 24V | YES | 0x93 | 0xXX7B93XX OR 0xXX7BFFXX | 0x18FBFF93 |
| 320 | PUMP — PIN A — [resistor] — 24V | YES | 0x94 | 0xXX7B94XX OR 0xXX7BFFXX | 0x18FBFF94 |
| 325 | PUMP — PIN A — [resistor] — 24V | YES | 0x97 | 0xXX7B97XX OR 0xXX7BFFXX | 0x18FBFF97 |

FIG. 3

PUMP WITH COMBINED ELECTRICAL CONTACT

RELATED APPLICATIONS

This application claims the benefit of priority to U.S. Provisional Patent Application No. 63/323,900, filed on Mar. 25, 2022, the entire content of which is hereby incorporated by reference.

FIELD OF THE INVENTION

The present invention relates to a pump, and more specifically, a pump having electrical contacts.

SUMMARY

Pumps are used to control flow rate and pressure of a fluid and/or gas and direct the fluid and/or gas to other devices. Vehicles typically include a plurality of pumps to control the flow of various fluids throughout the vehicle. Pumps are configured to perform operations in the event an event occurs, for example if an error condition is detected. Pumps also may be assigned different addresses by a system controller vehicle. However, known designs may be met with cost and wiring savings constraints.

The disclosure provides, in one aspect, a vehicle system including a pump having a motor and a pullout configuration with an electrical contact. The electrical contact receives and transmits signals related to an operation of the pump and an address selection. The pump also includes a motor controller. The vehicle system includes a system controller bus communicatively connected to the pinout configuration and a system controller communicatively connected to the pump via the system controller bus. The system controller determines that the electrical contact is energized, determines that a resistor is electrically connected to the electrical contact after determining that the electrical contact is energized, determines a resistance value of the resistor after determining that the resistor is electrically connected to the electrical contact, identifies the pump based on the resistance value, and transmits a control signal to the motor controller to control the operation of the pump.

The disclosure provides, in another aspect, a method for controlling a pump of a vehicle. The method includes receiving power at the pump, determining, via a system controller, that an electrical contact is energized, determining, via the system controller, that a resistor is electrically connected to the electrical contact after determining that the electrical contact is energized, and determining, via the system controller, a resistance value of the resistor after determining that the resistor is electrically connected to the electrical contact. The method also includes identifying, via the system controller, the pump based on the resistance value, receiving, via a motor controller, a control signal from the system controller, and controlling, via the motor controller, an operation of a motor of the pump based on the control signal.

Other aspects of the invention will become apparent by consideration of the detailed description and accompanying drawings.

BRIEF DESCRIPTION OF THE DRAWINGS

FIG. 3 is a table of communication protocol and pinout configuration of the pump of FIG. 2, according to one embodiment.

DETAILED DESCRIPTION OF THE DRAWINGS

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways.

Figure 1:
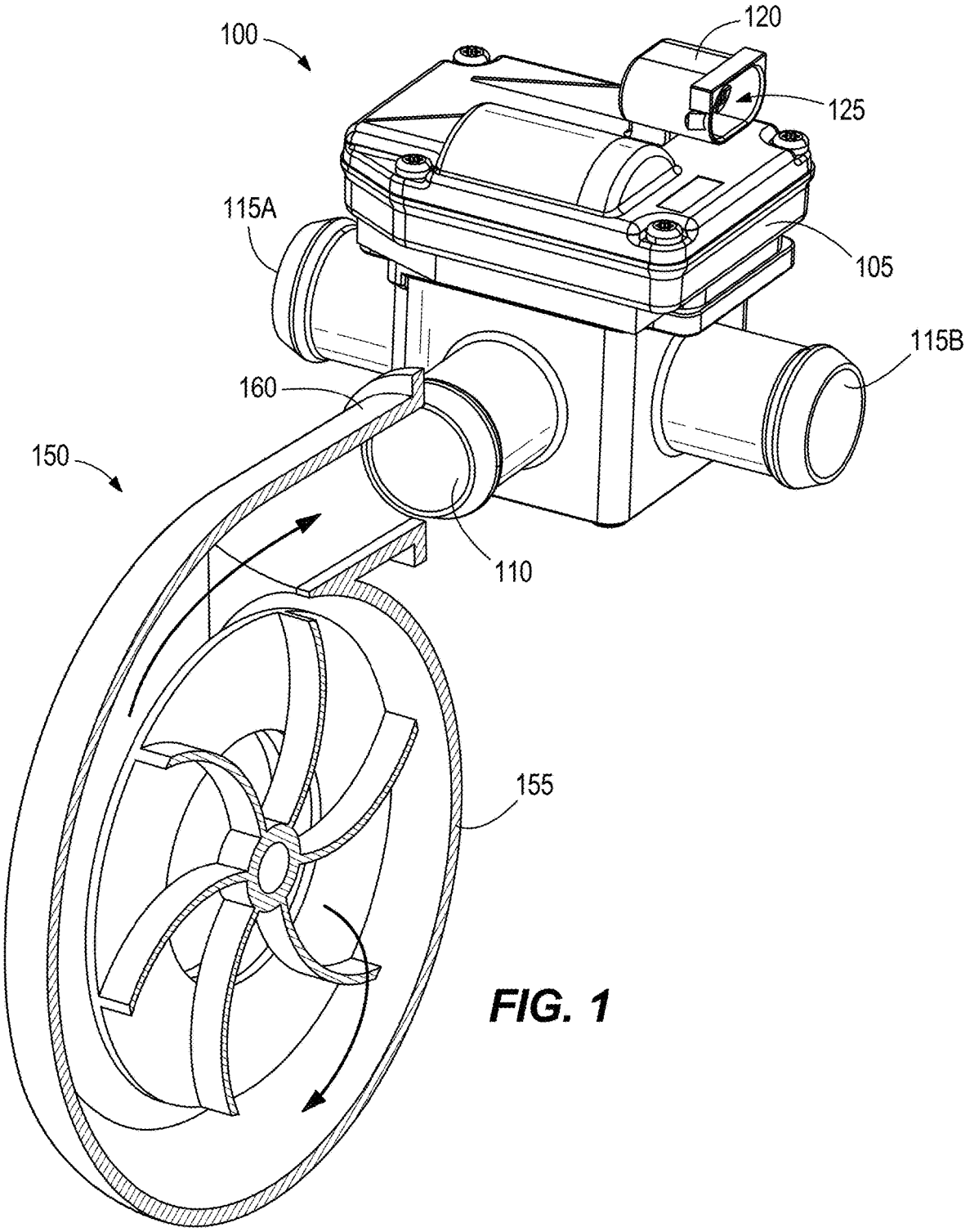
FIG. 1 illustrates a system including a pump and a valve, according to one embodiment.

FIG. 1 illustrates a system including a valve 100 and a pump 150, according to some embodiments. In the illustrated embodiment, the valve 100 is a three-way valve. The valve 100 includes a housing 105, a main chamber within the housing 105, a first tube 110, a second tube 115A, and a third tube 115B. The first tube 110, the second tube 115A, and the third tube 115B are in communication with the main chamber of the housing 105 to define passageways for fluid and/or gas to flow through the valve 100. The valve 100 also includes an electrical port 120. In the illustrated embodiment, the electrical port 120 includes a pinout configuration 125 with a plurality of electrical connectors. In some embodiments, the valve 100 is mechanically coupled to an external device via the electrical port 120 and is electrically coupled to the external device via the pinout configuration 125. The pullout configuration 125 receives and transmits control signals from the external device to the components of the valve 100. In some embodiments, the pinout configuration 125 receives and transmits power to the valve 100. In some embodiments, the valve 100 is a component making up part of a fluid system and is fluidly coupled to the pump 150. The pump 150 may be a component of a vehicle system. In other embodiments, the valve 100 is physically and/or operatively connected the pump, a fan, a compressor, or any other suitable component of the vehicle system mechanically via the electrical port 120. The valve 100 is physically and/or operatively connected the pump, a fan, a compressor, or any other suitable component of the vehicle system electrically via the pullout configuration 125.

The pump 150 includes a pump housing 155 and an outlet tube 160. As described above, the pump 150 is a component making up part of the vehicle system and the outlet tube 160 is fluidly coupled to the first tube 110 of the valve 100. In some embodiments, the pump 150 includes an electrical port (further described below in reference to FIGS. 2-3) similar to the electrical port 125 described above with respect to the valve 100. The electrical port of the pump 150 includes a pinout configuration with a plurality of electrical connectors (further described below in reference to FIGS. 2-3) similar to the pinout configuration 125 described above with respect to the valve 100. The pump 150 is designed to increase the flow rate and static pressure of a fluid and/or gas and direct the fluid and/or gas to the valve 100. The pump 150 may be, for example, a positive-displacement pump, a centrifugal pump, an axial-flow pump, or any other suitable pump for use in a vehicle system.

Figure 2:
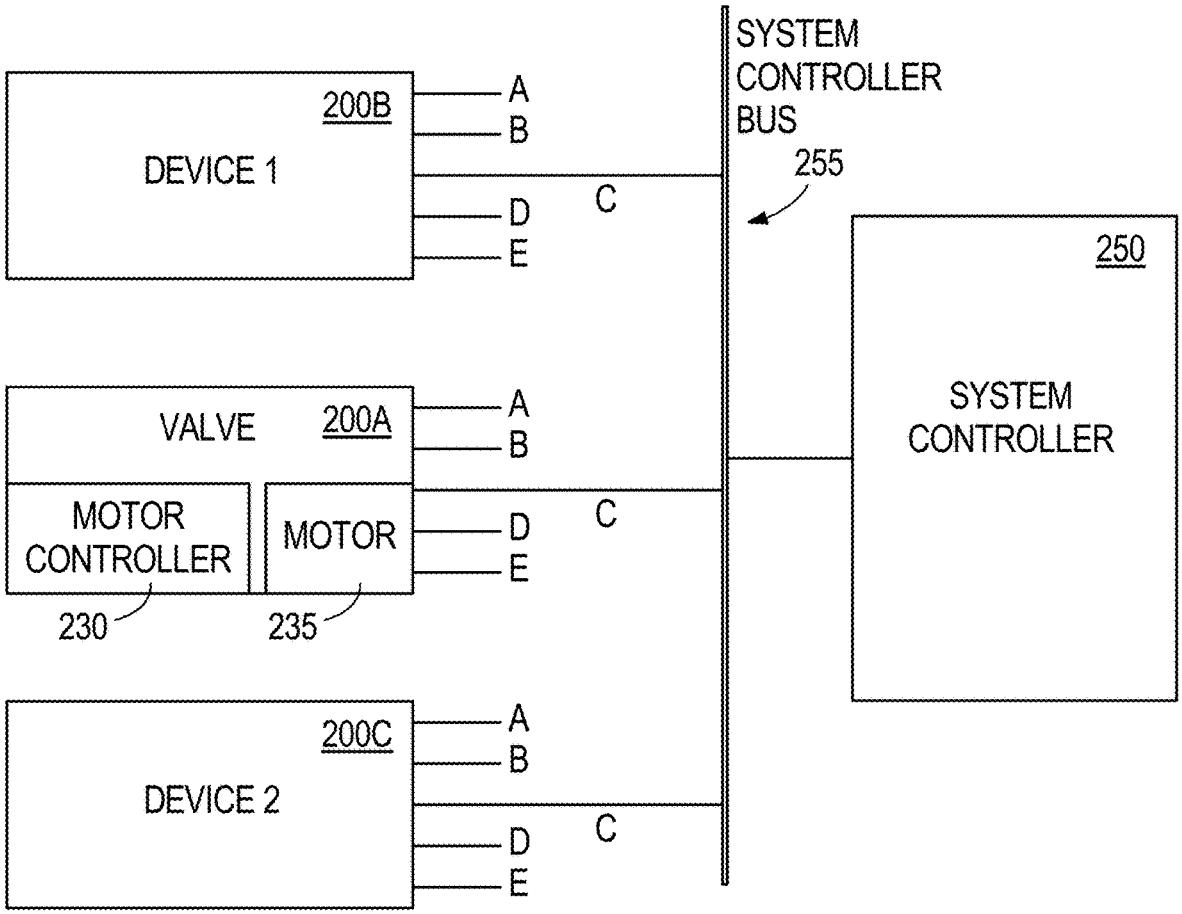
FIG. 2 is a block diagram of a vehicle system for controlling a pump, according to one embodiment.

FIG. 2 is a block diagram of a vehicle system for controlling a pump 200A, according to some embodiments. In some embodiments, the pump 200A is similar to the pump 150 described above in reference to FIG. 1. The pump 200A is a component making up part of the vehicle system such as, for example, a cooling system of the vehicle. The vehicle system may be a fuel system, cooling system, bleed air system, or the like. The vehicle may be an automobile, an electric automobile, a motorcycle, a truck, a bus, and others. The pump 200A includes a motor controller 230 and a motor 235 in electrical contact with the pinout configuration (e.g., similar to the pinout configuration 125). The motor 235 and motor controller 230 may be positioned within the pump housing 155. The motor 235 is configured to perform an operation (e.g., an error operation or failsafe operation) of the pump 200A based on a control signal received from the motor controller 230. For example, the motor 235 decreases speed in response to receiving the control signal to decrease flow rate and static pressure of the fluid and/or gas based on a control failure. In other examples, the motor 235 maintains speed in response to receiving the control signal to maintain a current flow rate and static pressure of the fluid and/or gas based on the control failure. In some embodiments, the control failure results in the absence of one or more control signals received by the motor controller 230. In other embodiments, the control failure is a loss of power. The motor 235 is an electrical motor, such as but not limited to a direct-current motor operable at variable speeds. In some embodiments, the motor 235 is a brushless direct-current (BLDC) motor. In other embodiments, the motor 235 can be a variety of other types of motors, including but not limited to a brush DC motor, a stepper motor, a synchronous motor, or other direct-current or alternating-current motors.

The motor controller 230 is electrically connected to the motor 235 and provides one or more control signals to operate the motor 235. The motor controller 230 includes a plurality of electrical and electronic components that provide power, operational control, and protection to the components and modules within the motor controller 230 and/or the motor 235. For example, the motor controller 230 includes, among other things, a processing unit (e.g., a microprocessor, a microcontroller, or another suitable programmable device) and a memory unit. In some embodiments, the motor controller 230 is implemented partially or entirely on a semiconductor (e.g., a field-programmable gate array ["FPGA"] semiconductor, an application specific integrated circuit ["ASIC"], or other programmable semiconductor devices as appropriate for a given application) chip, such as a chip developed through a register transfer level ("RTL") design process. In one example, upon receiving a control signal, the motor controller 230 controls and/or operates the switching of a plurality of electronic switches (e.g., FETs), in order to selectively drive the motor 235 at a speed and/or direction. In some embodiments, the motor controller 230 and the motor 235 form a single unit. In other embodiments, the motor controller 230 and the motor 235 are individual components of the pump 200A.

The pump 200A includes a plurality of electrical connectors (e.g., inputs, outputs, input/outputs [e.g., general purpose input/output "GPIO"], etc.). In some embodiments, the plurality of electrical connectors (for example, electrical contacts) includes a battery positive connector A, a battery negative (e.g., ground) connector B, a control signal connector C, an enable signal connector D, and an operation (e.g., error operation) connector E.

FIGS. 2-3 illustrate the pinout configuration which includes the plurality of electrical connectors A-E (e.g., pins, inputs, outputs, input/outputs, etc.). In some embodiments, the plurality of electrical connectors A-E includes the battery positive connector A, the battery negative connector B, the control signal connector C, the enable signal connector D, and the operation connector E. Although shown in FIG. 2 as connectors A, B, C, D, and E, each connector of the pinout configuration may be assigned to any one of the associated connectors shown in any order. The control signal connector C is configured to be electrically connected to a system controller 250 via electrical contact with a system controller bus 255. In reference to FIG. 2, although the control signal connector is shown as connector C, the control signal connector C may be any one of the plurality of connectors. The system controller bus 255 is configured to be in electrical contact with the pump 200A, a first device 200B, and a second device 200C. The first device 200B and the second device 200C are other components of the vehicle system, for example, a compressor, a fan, or any suitable vehicle component. In some embodiments, the first device 200B and the second device 200C include a similar pinout configuration to the pump 200A. The system controller bus 255 may use one or more known control bus protocols, such as a Controller Area Network (CAN) bus protocol, a Local Interconnect Network (LIN) bus protocol, or other control bus protocol types as required for a given application. In some embodiments, the system controller 250 may be configured to communicate using multiple control bus protocols.

With continued reference to FIG. 2, the control signal connector C connects to the system controller bus 255 of the vehicle for communication of control protocol of the pump 200A. In one embodiment, the system controller 250 and system controller bus 255 are the same as a CAN controller and CAN bus and/or LIN controller and LIN bus. In other embodiments, the system controller 250 and system controller bus 255 are separate from the vehicle's CAN controller and CAN bus and/or LIN controller and LIN bus. In some embodiments, the control signal connector C may connect directly to a CAN bus or LIN bus of the vehicle. In some embodiments, the LIN bus may be a sub-bus of the CAN bus of the vehicle. The operation connector E may be connected to a power source (e.g., a vehicle battery). In some embodiments, the operation connector E is connected to the system controller 250 or the system controller bus 255 to receive power. In some embodiments, a resistor is electrically connected between the operation connector E and the power source (further described below in reference to FIG. 3). The operation connector E receives and transmits one or more signals to the system controller 250 related to the operation (e.g., an error operation or a failsafe operation) and an address selection of the pump 200A. The connection of the operation connector E determines the address selection of the pump 200A and the operation of the pump 200A in the event of control failure (i.e., no control signal from the system controller 250 is received via the control signal connector C or a loss of power occurs). For example, if the operation connector E is connected to a first resistor with a first resistance value, the pump 200A is assigned a first address. If the operation connector E is connected to a second resistor with a second resistance valve, the pump 200A is assigned a second address. Therefore, the address selection may be dependent on the electrical connection of the operation connector E. The battery positive connector A is electrically connected to a positive terminal of the vehicle battery to provide power to the pump 200A. In some embodiments, the battery positive connector A is electrically connected to the system controller 450 or the system controller bus 455 to receive power. The battery negative terminal B is electrically connected to a negative terminal of the vehicle battery to ground the pump 200A. In some embodiments, the battery negative terminal B is electrically connected to a ground terminal of the system controller 450 or the system controller bus 455 to ground the pump 200A. The enable signal connector D is electrically connected to the system controller 450 or the system controller bus 455 to allow the control signal connector C to receive control signals from the system controller 450. For example, the enable signal connector D allows control signals to be received and transmitted by the control signal connector C when the pump 200A is receiving power.

The system controller 250 can include a plurality of electrical and electronic components that provide power, operational control, and protection to the components and modules within the system controller 250 and/or the pump 200A. For example, the system controller 250 includes, among other things, a processing unit (e.g., a microprocessor, a microcontroller, or another suitable programmable device) and a memory. In some embodiments, the system controller 250 is implemented partially or entirely on a semiconductor (e.g., a field-programmable gate array ["FPGA"] semiconductor, an application specific integrated circuit ["ASIC"], or other programmable semiconductor devices as appropriate for a given application) chip, such as a chip developed through a register transfer level ("RTL") design process.

The memory includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The illustrated processing unit is connected to the memory and executes software instructions that are capable of being stored in a RAM of the memory (e.g., during execution), a ROM of the memory (e.g., on a generally permanent basis), or another non-transitory computer readable medium such as another memory or a disc. Software included in some implementations of the pump 200A can be stored in the memory of the system controller 250. The software can include, for example, firmware, one or more applications, program data, filters, rules, one or more program modules, and other executable instructions. The system controller 250 is configured to retrieve from memory and execute, among other things, instructions related to the control processes and methods described herein. In other constructions, the system controller 250 includes additional, fewer, or different components.

In operation, the system controller 250 outputs a control signal to the motor controller 230. The motor controller 230 receives the control signal and operates the motor 235 based on the control signal. In some embodiments, the control signal is a pulse-width modulated signal. The pulse-width modulated signal can have a duty cycle (e.g., 10%, 50%, 100%, etc.). In some embodiments, the duty cycle corresponds to an operating speed of the motor 235 (e.g., 10% of full speed, 50% of full speed, 100% of full speed, etc.).

The system controller 250 may further include a communications module. The communications module provides analog and/or digital communications from the system controller 250 to outside devices. In some embodiments, the communications module outputs diagnostic information concerning the system controller 250 and/or other components of the cooling system. The communications module may include an output driver in the form of a digital driver such as SAE J1939, CAN bus, or LIN bus for communicating directly to the vehicle's data bus, or the communications module may generate another suitable analog or digital signal depending on the needs of the specific application. The communication module may further be configured to receive data from one or more data buses within the vehicle, such as SAE J1939, CAN bus, and/or LIN bus.

FIG. 3 is a table 300 of a standard CAN communication protocol used with a FBFF (FD Base Frame Format) data frame including 11-bit identifiers for addressing the pump 200A via the system controller 250 or system controller bus 255, according to some embodiments. In one embodiment, the system controller 250 and system controller bus 255 are the same as a CAN controller and CAN bus and/or LIN controller and LIN bus. In other examples, the system controller 250 and system controller bus 255 are separate from the vehicle's CAN controller and CAN bus and/or LIN controller and LIN bus. Although the identification of the pump 200A is shown in FIG. 3 as using the CAN communication protocol via the FBFF data frame, the communication protocol between the pump 200A and the system controller 250 or system controller bus 255 may encompass various types of communication protocols. For example, the communication protocol may include SAE J1939, ISO 11898, or any CAN 2.0 data frames. In the illustrated embodiment, the pump pullout configuration (e.g., similar to the pinout configuration 125) includes a single connection for the error operation and the address selection (e.g., the operation connector E). The single pin connection is advantageous for allowing more options for electrical connection selection and saving on wiring cost and space. Although described relative to the pump 200A, the illustrated embodiment may be used in multiple applications, including but not limited to pumps, fans, compressors, blowers, and any fluid moving devices.

As described above, the pump 200A is in electrical communication with the system controller 250 or system controller bus 255 via the control signal connector C, in which the pump 200A receives a control signal from the system controller 250 or system controller bus 255 indicative of a control operation and a control address. In some embodiments, a resistor is electrically connected in line (e.g., in series) with the operation connector E (e.g., Pin A in FIG. 3). In some embodiments, such as row 305, the operation connector E is left open (e.g., not electrically connected to an external connection). In such embodiments, the system controller 250 determines that the operation connector E is electrically open and identifies the pump 200A based on the operation connector E being left open and assigns the pump 200A an address. For example, the system controller 250 determines that the resistor is not electrically connected to the operation connector E. In some embodiments, such as row 310, the operation connector E is electrically connected to the power source terminal. In such embodiments, the system controller 250 determines that the operation connector E is only connected to the power source terminal and identifies the pump 200A based on the operation connector E being connected to the power source terminal and assigns the pump 200A an address. In some embodiments, a first end of the resistor is connected to the operation connector E and a second end of the resistor is connected to a terminal of the power source as shown by rows 315, 320, 325. A resistance value of the resistor is measured by the system controller 250 to identify the pump 200A based on the resistance value. For example, row 315 has a first resistor with a first resistance value, row 320 has a second resistor with a second resistance value, and row 325 has a third resistor with a third resistance value. Accordingly, the pump 200A in row 315 is assigned a first address, the pump 200A in row 320 is assigned a second address, and the pump 200A in row 325 is assigned a third address based on the respective resistance value of the resistor.

In some embodiments, the resistance value of the resistor is based on a voltage level detected at the operation connector E connection point to the resistor. In other embodiments, the resistance value of the resistor is based on a measured current flowing through the resistor. Additionally, combinations of voltages across the resistor and/or current through the resistor may be used to determine a resistance value of the resistor. In some examples, the system controller 250 determines the resistance of the resistor. The pump 200A may be identified based on the measured value of resistance and perform an operation (e.g., the error operation) based on any control signal received via the operation connector E. In some embodiments, a plurality of pumps can be connected to the system controller 250 via the system controller bus 255. Therefore, each pump of the plurality of pumps includes a different resistor with a different resistance value. The different resistance value of each resistor allows for identification of each pump.

Figure 4:
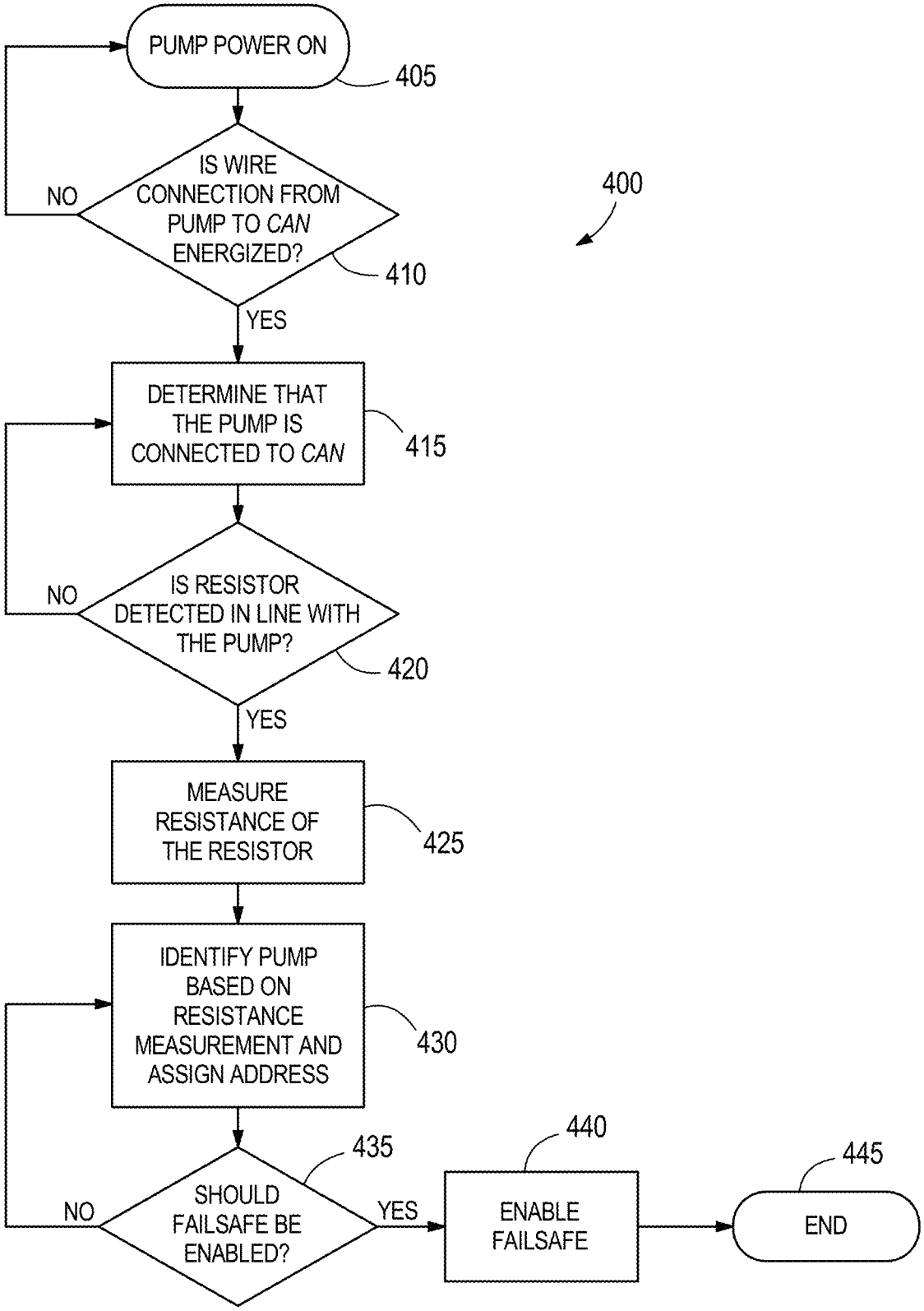
FIG. 4 is a flow chart of a method for controlling a pump of a vehicle, according to one embodiment.

FIG. 4 is a flow chart of a method 400 for controlling a pump (e.g., the pump 200A) of a vehicle, according to some embodiments. Although the method 400 is described herein with reference to the pump 200A, the method 400 may be executed to control the pump 150. The order of the steps disclosed in the method 400 could vary. For example, additional steps may be added to the process and not all of the steps may be required, or steps shown in one order may occur in a second order. In one embodiment, the system controller 250 is configured to execute the method 400. In other embodiments, the system controller 250 is configured to execute the method 400 in combination with the motor controller 230. The method 400 begins at step 405 when the pump 200A receives power. For example, the system controller 250 determines that the pump 200A is energized based on the electrical connection of the battery positive terminal A. The method 400 then proceeds to step 410.

At step 410, the system controller 250 determines that the operation connector E is operable by the system controller 250. For example, the system controller 250 determines that the operation connector E is energized or power is detected by the system controller 250 on the operation connector E. If the operation connector E is not determined to be operable by the system controller 250, the method 400 returns to step 405. The method 400 then proceeds to step 415. At step 415, the system controller 250 determines that the pump 200A is connected to the system controller bus 455. For example, the system controller 250 determines that the control signal connector C is energized and operable by the system controller 250. The method 400 then proceeds to step 420.

At step 420, the system controller 250 determines whether a resistor is detected in line with the operation connector E. For example, the system controller 250 measures the voltage and/or current at the operation connector E. If the system controller 250 determines a difference from an expected voltage and/or current at the operation connector E, the system controller determines that the resistor is in line with the operation connector E. In response to determining that the resistor is not detected in line with the operation connector E, the method 400 returns to step 415. The method 400 proceeds to step 425 in response to the system controller 450 determining that the resistor is in line with the operation connector E.

At step 425, the resistance value of the resistor is measured. For example, the system controller 250 may measure combinations of voltages across the resistor and/or current through the resistor may be used to determine a resistance value of the resistor. The method 400 proceeds to step 430. At step 430, the pump 200A is identified by the system controller 250 based on the determined resistance value. The system controller 250 assigns an address (via the system controller bus 255) to the pump 200A based on the identification of the pump 200A. For example, the system controller 250 assigns the first address to the pump 200A based on determining the first resistance value, assigns the second address to the pump 200A based on determining the second resistance value, and so on. The system controller 250 assigns the address to the pump 200A based on a CAN communication protocol, as described above. In some instances, the system controller 250 determines that the operation connector E is electrically open. In such instances, the system controller 250 identifies the pump 200A and assigns an address to the pump 200A based on determining that the operation connector E is electrically open. For example, the system controller 250 determined that the operation connector E is electrically open and assigns a default address to the pump 200A to the pump 200A. The default address assigned to the pump 200A when the operation connector E is electrically open is different than any address assigned to the pump 200A when the resistor is determined to be in line with the operation connector E. When the operation connector E is electrically open, the pump 200A may not perform an error operation via the motor 235. In some instances, the system controller 250 determines that the operation connector E is electrically connected to the power source terminal without a resistor. In such instances, the system controller identifies the pump 200A and assigns an address to the pump 200A based on determining that the operation connector E is electrically connected to the power source terminal. The address assigned to the pump 200A when the operation connector E is electrically connected to the power source terminal is different than any address assigned to the pump 200A when the resistor is determined to be in line with the operation connector E or the operation connector E is electrically open. The method 400 then proceeds to step 435.

At step 435, the system controller 250 determines whether the operation needs to be enabled. For example, the system controller 250 determines that an error operation (e.g., no control signal from the system controller 250 is able to be sent via the control signal connector C or a loss of power occurs) is occurring. In response to determining that the operation needs to be enabled, the method 400 proceeds to enable (e.g., activate) the operation at step 440. In some instances, the operation is an error operation, as described above. In response to the system controller 250 determining that no operation is needed, the method returns to step 430. At step 440, the system controller 250 transmits a control signal to the motor controller 230 to control the operation. The motor controller 230 enables the operation of the pump 200A based on the motor controller 230 receiving the control signal. The method 400 then proceeds to step 445 in which the method 400 ends.

Although the invention has been described with reference to certain preferred embodiments, variations and modifications exist within the scope and spirit of one or more independent aspects of the invention as described.

The invention claimed is:

1. A vehicle system comprising:

a pump including a motor;

a pinout configuration with an electrical contact, wherein electrical contact is configured to receive and transmit signals related to an operation of the pump and an address selection;

a motor controller;

a system controller bus communicatively connected to the pinout configuration; and a system controller communicatively connected to the pump via the system controller bus, the system controller configured to:

determine that the electrical contact is energized;

determine that a resistor is electrically connected to the electrical contact after determining that the electrical contact is energized;

determine a resistance value of the resistor after determining that the resistor is electrically connected to the electrical contact;

identify the pump based on the resistance value; and transmit a control signal to the motor controller to control the operation of the pump.

2. The system of claim 1, wherein identifying the pump based on the resistance value includes:

assigning, via the system controller, an address to the pump based on the identified pump.

3. The system of claim 2, wherein the system controller assigns the address to the pump using a CAN communication protocol.

4. The system of claim 1, wherein the system controller is configured to:

determine that the operation of the pump is activated; and transmit the control signal to the motor controller based on determining that the operation of the pump is activated.

5. The system of claim 1, wherein determining that the electrical contact is energized includes:

determine, via the system controller, that the electrical contact is receiving power.

6. The system of claim 1, wherein the resistor is electrically connected between the electrical contact and a power source terminal.

7. The system of claim 1, wherein the electrical contact is a single pin connection.

8. The system of claim 1, wherein the system controller is configured to:

determine that the electrical contact is electrically open; and identify the pump based on determining that the electrical contact is electrically open.

9. The system of claim 8, wherein, when determining that the electrical contact is electrically open, the system controller is configured to:

determine that the resistor is electrically disconnected from the electrical contact.

10. The system of claim 1, wherein the system controller is configured to:

determine that the electrical contact is electrically connected to a power source terminal; and identify the pump based on determining that the electrical contact is electrically connected to the power source terminal.

11. A method for controlling a pump of a vehicle, the method comprising:

receiving power at the pump;

determining, via a system controller, that an electrical contact is energized;

determining, via the system controller, that a resistor is electrically connected to the electrical contact after determining that the electrical contact is energized;

determining, via the system controller, a resistance value of the resistor after determining that the resistor is electrically connected to the electrical contact;

identifying, via the system controller, the pump based on the resistance value;

receiving, via a motor controller, a control signal from the system controller; and controlling, via the motor controller, an operation of a motor of the pump based on the control signal.

12. The method of claim 11, wherein identifying the pump based on the resistance value includes:

assigning, via the system controller, an address to the pump based on the identified pump.

13. The method of claim 12, wherein the system controller assigns an address to the pump based on a CAN communication protocol.

14. The method of claim 11, comprising:

determining, via the system controller, that the operation of the pump is activated; and transmitting the control signal to the motor controller based on determining that the operation of the pump is activated.

15. The method of claim 11, wherein determining that the electrical contact is energized includes:

determining, via the system controller, that the electrical contact is receiving power.

16. The method of claim 11, comprising:

determining, via the system controller, that the pump is connected to a CAN bus.

17. The method of claim 11, wherein the resistor is connected between the electrical contact and a power source terminal.

18. The method of claim 11, wherein the electrical contact is a single pin connection.

19. The method of claim 11, comprising:

determining, via the system controller, that the electrical contact is electrically open; and identifying, via the system controller, the pump based on determining that the electrical contact is electrically open.

20. The method of claim 11, comprising:

determining, via the system controller, that the electrical contact is electrically connected to a power source terminal; and identifying, via the system controller, the pump based on determining that the electrical contact is electrically connected to the power source terminal.

* * * * *